US005810576A

United States Patent [19]

Franchi et al.

[11] Patent Number: 5,810,576

[45] Date of Patent: Sep. 22, 1998

[54] METHOD FOR SILENCING AND STABILIZING THE FLAME OF GAS BURNERS FED VIA PULSE WIDTH MODULATION-CONTROLLED ELECTROMAGNETIC VALVES

[75] Inventors: Daniele Franchi, Bodio Lomnago; Luca Frasnetti, Cunardo; Marco Maritan, Viggiú, all of Italy

[73] Assignee: Whirlpool Corporation, Benton Harbor, Mich.

[21] Appl. No.: 825,042

[22] Filed: Mar. 27, 1997

[30] Foreign Application Priority Data

Apr. 4, 1996 [IT] Italy ..... MI96A0661

[51] Int. Cl.[6] ..... F23D 14/46

[52] U.S. Cl. ..... 431/114; 431/1; 431/350

[58] Field of Search ..... 431/1, 114, 350

[56] References Cited

U.S. PATENT DOCUMENTS

| | | | |
|---|---|---|---|
| 5,234,196 | 8/1993 | Harris | 251/328 |
| 5,379,683 | 1/1995 | Ejiri et al. | 431/1 |
| 5,386,815 | 2/1995 | Ejiri et al. | 431/1 |

FOREIGN PATENT DOCUMENTS

| | | | |
|---|---|---|---|
| 473451A1 | 3/1992 | European Pat. Off. | G01N 21/72 |
| 532339A1 | 3/1993 | European Pat. Off. | F23C 11/04 |

*Primary Examiner*—Carroll B. Dority
*Attorney, Agent, or Firm*—Robert O. Rice; Thomas J. Roth; Joel M. Van Winkle

[57] ABSTRACT

The method consists of providing a portion of greater cross-section in the gas feed conduit between the electromagnetic valve and the diffuser in a gas appliance, preferably for cooking or heating food.

8 Claims, 1 Drawing Sheet

METHOD FOR SILENCING AND STABILIZING THE FLAME OF GAS BURNERS FED VIA PULSE WIDTH MODULATION-CONTROLLED ELECTROMAGNETIC VALVES

BACKGROUND OF THE INVENTION

1. Field of the Invention

This invention relates to a method for silencing and stabilizing the flame of gas burners fed via pulse width modulation-controlled electromagnetic valves.

The invention also relates to the means for implementing the method.

2. Description of the Related Art

It is known, for example from EP-A-0550340, to feed a gas burner via a pulse width modulation-controlled electromagnetic valve.

The valve throughput is a function of the duty cycle of the valve opening signal, this (variable) duty cycle being set by the user, for example by acting on a knob or on keys, in relation to the thermal power to be provided by the burner.

In other simpler words the flame is set by the user by fixing the percentage of a predetermined time during which the valve is maintained open. If this percentage is 100%, maximum flame is obtained, the flame being smaller at lower percentages.

At the lowest operating percentages, the consequent throughput fluctuations generate a pulsating flame at the burner with consequent increase in the so-called "flame noise" and in the possibility that the flame becomes unstable and finally extinguished.

SUMMARY OF THE INVENTION

The main object of the present invention is therefore to provide a method and means for stabilizing the flame, while at the same time reducing "flame noise".

This and further objects which will be more apparent from the detailed description given hereinafter are attained by the method and means in accordance with the accompanying claims.

BRIEF DESCRIPTION OF THE DRAWINGS

The invention will be better understood from the detailed description of a preferred embodiment thereof given hereinafter and illustrated on the accompanying drawing, in which.

DESCRIPTION OF THE PREFERRED EMBODIMENTS

Figure 1:
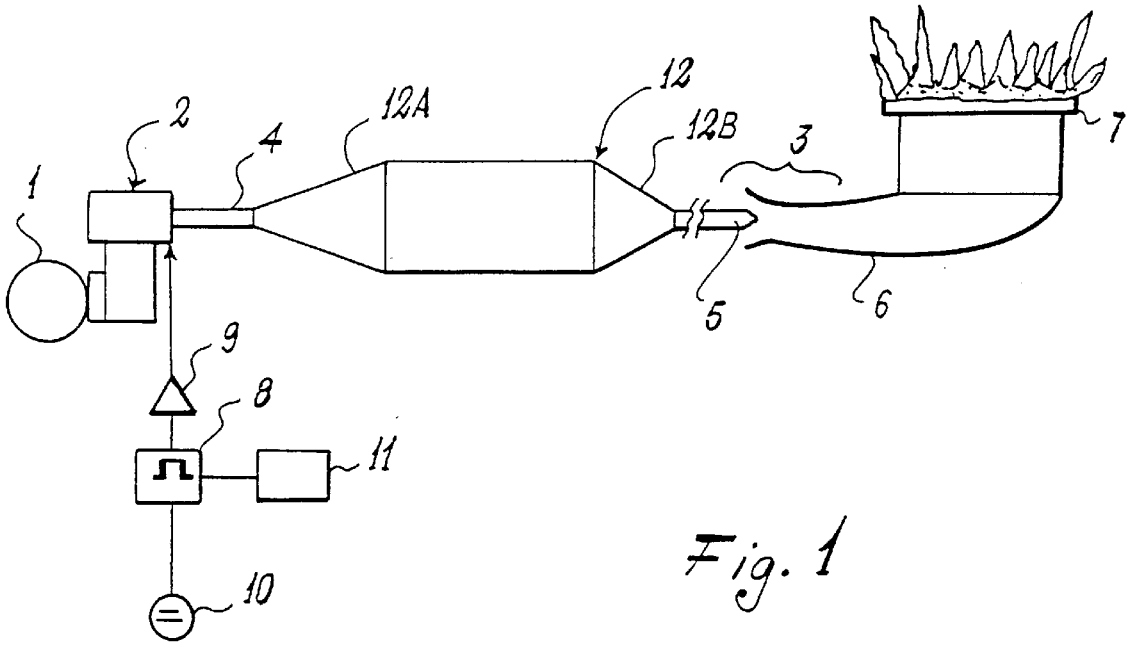
FIG. 1 is a schematic view of the invention.

In the figures the reference numeral 1 indicates the gas feed pipe from any suitable source, which can be the gas distribution mains or a cylinder. To the pipe 1 there is connected a known electromagnetic valve able to alternately interrupt gas passage under the control of variable-width pulses.

The outlet of the valve in question is connected by a conduit 4 to a conventional injector 3 which, as such, comprises a nozzle 5 and a venturi 6. The injector is in fluid communication with a burner 7.

The electromagnetic valve is controlled on the basis of signals emitted by a modulator device 8 and amplified by an amplifier 9. The modulator device 8 is connected to any direct current source 10 (such as a full wave rectifier provided with filters and connected to the electrical mains supply).

A regulator system 11 comprising an electronic card connected to analog or digital control members is connected to the modulator 8. These control members can be analog sliders or potentiometers, or digital keys or contacts which enable the user to preset the thermal power emitted by the burner according to his requirements of the moment. Hence said members act on the card to change the state of the system until it corresponds to the required gas throughput. On the basis of this state the modulator device 8 determines the duration of closure/opening of the valve 2 by modulating the signal fed to it.

According to the invention, in order to reduce the "flame noise" in general and the flame pulsations when the burner is at low thermal power, within the conduit 4 there is provided a portion 12 having a cross-section greater than that of said conduit. The portion 12 can for example be formed by modifying the conduit 4 by mechanical operations or by inserting additional components into the conduit and fixing them thereto by welding, by ring nuts or by other known means able to ensure a perfect seal at the points of juncture. The volume enclosed by said portion 12 can, in the case of burners for cooking hobs such as that shown, vary preferably from 15 to 350 $cm^3$ with a ratio of the diameter of its cross-section to that of the conduit 4 of preferably between 3 and 6. The cross-section through the portion 12 is preferably circular but can be of other shapes and/or positioned closer to the nozzle 5.

Any material allowed by current safety regulations can be used to construct the portion 12 and any components connected to it. Advantageously, in order to reduce pressure drops and relative turbulent motion to a minimum, both at the inlet and at the outlet of the portion 12, connection pieces 12A and 12B of gradually increasing and respectively decreasing cross-section (for example conical) are provided as shown in FIG. 1.

Figure 2:
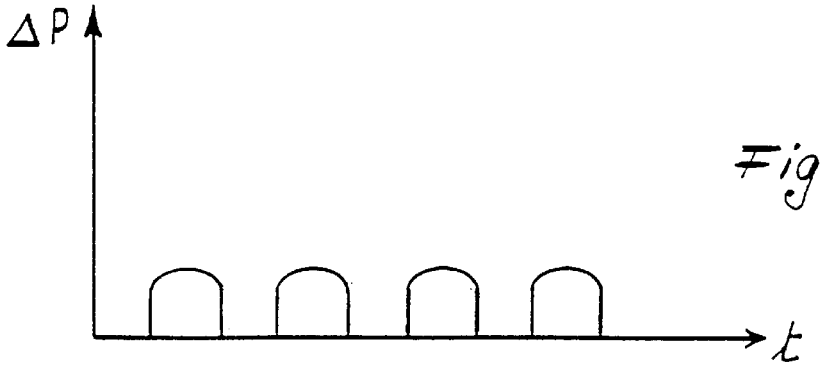
FIGS. 2 and 3 represent operating graphs.
Figure 3:
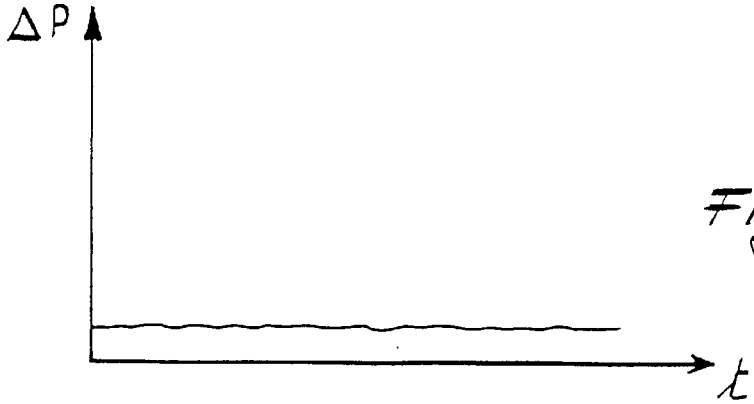

The advantageous results of using the portion 12, which can in fact be considered a silencer/stabilizer, can be seen from FIGS. 2 and 3, which show the variation in gauge pressure $\Delta P$ against time, the value $\Delta P$ being, in the case of FIG. 2, measured at any point of that conduit, without the silencer/stabilizer. which in conventional arrangements connects the electromagnetic valve to the diffuser, whereas in the case of FIG. 3 the value $\Delta P$ is measured at the exit of the silencer/stabilizer 12 of adequate dimensions in the arrangement of the invention. The $\Delta P$ measurements are obviously made under the same conditions and hence for equal duty cycles. As can be seen on comparing the graphs, the use of the silencer/stabilizer 12 results in a substantial reduction in pulsations, which can in practice reach annulment.

It should be noted that where the gas enters the portion 12 there is an energy conversion in the sense that part of the kinetic energy of the gaseous stream is converted into pressure energy (piezometric), and vice versa at its exit from said portion.

We claim:

1. A gas appliance having a burner fed via a diffuser and a pulse width modulation-controlled electromagnetic valve, the diffuser and valve being connected together by a gas feed conduit having a circular cross-section, the gas feed conduit comprising:

a portion having a circular cross-section greater than that of the conduit itself, wherein the ratio of the diameter of the portion to that of the gas feed conduit is between 3 and 6;

an inlet of the portion having a gradually increasing cross-section; and an outlet of the portion having a gradually decreasing cross-section.

2. An appliance as claimed in claim 1, wherein the gradually increasing cross-section of the inlet and the gradually decreasing cross-section of the outlet reduce the pressure drop during the passage of the gaseous stream from the conduit to the portion and back to the conduit.

3. An appliance as claimed in claim 2, wherein the portion is formed by mechanically modifying the conduit or is an additional component fixed to said conduit.

4. An appliance as claimed in claim 1, wherein the portion is formed by mechanically modifying the conduit or is an additional component fixed to said conduit.

5. A gas valve system connected between a gas feed pipe and an injector for a burner, consisting of:

a pulse width modulation-controlled electromagnetic valve fluidly connected to the gas feed pipe;

a nozzle;

a conduit extending between the valve and the nozzle; and an expansion portion provided along the conduit having a cross-section substantially greater than the conduit, wherein the expansion portion reduces the pressure pulsations caused by the opening and closing of the electromagnetic valve such that the nozzle is supplied with a flow of gas having a relatively constant pressure.

6. A gas valve system connected between a gas feed pipe and an injector for a burner, comprising:

a pulse width modulation controlled electromagnetic valve fluidly connected to the gas feed pipe;

an outlet nozzle;

a conduit extending between the valve and the nozzle; and an expansion portion provided along the conduit having a cross-section substantially greater than the conduit, such that the cycling of the electromagnetic valve controls the amount of gas supplied to the burner to control the flame size and the expansion portion reduces the pressure pulsations caused by the opening and closing of the electromagnetic valve such that the nozzle is supplied with a flow of gas having a relatively constant pressure such that a flame is continuously maintained on the burner.

7. The gas valve system according to claim 6, further comprising:

control means for supplying a signal to the electromagnetic valve for controlling the duration of the closure/opening of the electromagnetic valve.

8. The gas valve system according to claim 6, further wherein:

the conduit has a generally circular cross-section, and the expansion portion has a circular cross-section and the ratio of the diameter of the expansion portion to that of the gas feed conduit is between 3 and 6.

* * * * *